US005276489A

United States Patent [19]

Kikuchi et al.

[11] Patent Number: 5,276,489

[45] Date of Patent: Jan. 4, 1994

[54] IMAGE FORMING APPARATUS WITH TRANSFER ROLLER WITH GUIDE MEANS WHICH ADJUSTS TO MOVEMENTS OF THE ROLLER

[75] Inventors: Yutaka Kikuchi, Kawasaki; Junji Ichikawa, Kamakura, both of Japan

[73] Assignee: Canon Kabushiki Kaisha, Tokyo, Japan

[21] Appl. No.: 583,245

[22] Filed: Sep. 17, 1990

[30] Foreign Application Priority Data

Sep. 16, 1989 [JP] Japan ..... 1-238385
Sep. 16, 1989 [JP] Japan ..... 1-238386

[51] Int. Cl.[5] ..... G03G 15/16
[52] U.S. Cl. ..... 355/274; 355/277
[58] Field of Search ..... 355/271, 274, 277, 286

[56] References Cited

U.S. PATENT DOCUMENTS 3,817,615 6/1974 Adachi et al. ..... 325/274
4,110,027 8/1978 Sato et al. ..... 226/94 X
4,302,093 11/1981 Landa ..... 355/274
4,685,793 8/1987 Sawada et al. ..... 355/311
4,708,457 11/1987 Shimura ..... 355/274
4,786,938 11/1988 Carter ..... 355/271
4,847,652 7/1989 Masuda et al. ..... 355/274
4,894,686 1/1990 Bujese ..... 355/271
5,002,266 3/1991 Kikuchi et al. ..... 271/3

*Primary Examiner*—Leo P. Picard
*Assistant Examiner*—Christopher Horgan
*Attorney, Agent, or Firm*—Fitzpatrick, Cella, Harper & Scinto

[57] ABSTRACT

An image forming apparatus includes an image bearing member; a device for forming an image on the image bearing member; a transfer device for transferring the image from the image bearing member onto a recording material, the transfer device is in the form of a roller contactable to the image bearing member in its longitudinal direction; and a guiding member for guiding the recording material to a neighborhood of the image bearing member; wherein a positional relationship between the transfer device and the guide member is fixed, and wherein the transfer device is swingable toward and away from the image bearing member.

38 Claims, 5 Drawing Sheets

IMAGE FORMING APPARATUS WITH TRANSFER ROLLER WITH GUIDE MEANS WHICH ADJUSTS TO MOVEMENTS OF THE ROLLER

FIELD OF THE INVENTION AND RELATED ART

The present invention relates to an image forming apparatus of an electrophotographic type such as a laser beam printer or a copying machine.

In a copying machine or the like, a toner image formed on a photosensitive drum (image bearing member) is transferred onto the transfer material (transfer sheet) by a transfer charger. A transfer sheet is fed from a registration roller to a transfer position where the photosensitive drum and the transfer charger is faced in timed relation with the toner image on the photosensitive drum. Between the registration roller and the photosensitive drum or the transfer charger, there is provided a transfer sheet guide.

Referring first to FIG. 9, there is shown an example of a transfer sheet guide. A reference numeral 100 designates a photosensitive drum; 101 designates a transfer charger. The registration roller is indicated by a reference numeral 102. The transfer sheet guide is indicated by a reference numeral 103 and has an end at the registration roller 102 side where it is rotatably supported. The other end thereof is urged by a spring 104 to a recess 111 of a process cartridge 110 which contains the photosensitive drum 100, by which it is positioned relative to the photosensitive drum 100. By means of the transfer sheet guide 103, the transfer sheet from the registration roller 102 is properly guided to between the photosensitive drum 100 and the transfer charger 101.

Where the process cartridge 110 is of the type not containing the photosensitive drum 100, as shown in FIG. 10, a roller 105 is provided on an end of the transfer sheet guide 103, and the roller 105 is contacted to the photosensitive drum 100 to position the transfer sheet guide 103 relative to the photosensitive drum 100. By the transfer sheet guide 103, the transfer sheet P from the registration roller 102 is guided to between the photosensitive drum 100 and the transfer charger 101.

Thus, heretofore, by abutting an end of the transfer sheet guide 103 to the process cartridge 110 or to the photosensitive drum 100, the transfer sheet guide 103 is accurately positioned relative to the photosensitive drum 100 so that the proper image transfer action is imparted from the photosensitive drum 100 by the transfer charger 101.

However, even if the transfer sheet guide 103 is positioned relative to the photosensitive drum 100 by pressing an end of the transfer sheet guide 103 to the photosensitive drum 100 in an attempt to properly feed the transfer sheet P into a nip or clearance between the transfer charger 101 and the photosensitive drum 100, it has been difficult to correctly position the transfer sheet guide 103 relative to the nip or the clearance If the positioning is not correct, the transferred image becomes non-uniform or the toner is scattered.

In addition, not only the transfer sheet guide 103 but also the transfer charger 101 are pressed to the photosensitive drum 100, and the damage to the photosensitive drum 100 at the press-contact surface is increased.

Where the transfer charger 101 is of the type wherein it is contacted to the photosensitive drum 100, such as a transfer roller or a transfer belt, it is particularly desirable to feed the transfer sheet P into the nip formed between the transfer charger 101 and the photosensitive drum 100 in order to avoid a deteriorated image attributable to an improper transfer operation, and therefore, it is desirable for the transfer sheet guide 103 to be correctly positioned relative to the transfer charger 101 as well as to the photosensitive drum 100.

In the case of the structure shown in FIG. 12, the transfer sheet guide 103 is relatively easily triboelectrically charged by the friction with the transfer sheet P, and therefore, it is made of conductive material such as metal plate or the like, and it is electrically grounded through a resistor or varister, as desired.

In this case, in order to prevent the bias voltage applied to the transfer roller 101 from leaking to the transfer sheet guide 103, a clearance l of the order of 2–3 mm is desired between the transfer roller 101 and the tip end of the transfer sheet guide 103.

However, the provision of the clearance l results in bulky apparatus. In addition, it becomes difficult to dispose the end of the transfer sheet guide 103 close to the nip between the transfer drum 100 and the transfer roller 101. When the transfer sheet P is waved or curled, the transfer sheet P is not correctly guided into the nip with the possible result of a disturbed image on the transfer sheet P.

SUMMARY OF THE INVENTION

Accordingly, it is a principal object of the present invention to provide an image forming apparatus including a guiding member positioned correctly relative to both the image bearing member and the transfer means.

It is another object of the present invention to provide an image forming apparatus which is small in size.

It is a further object of the present invention to provide an image forming apparatus capable of forming images without non-uniform image transfer.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to FIGS. 1, 2, 3, 4, 5 and 6, the first embodiment of the present invention will be described.

Figure 1:
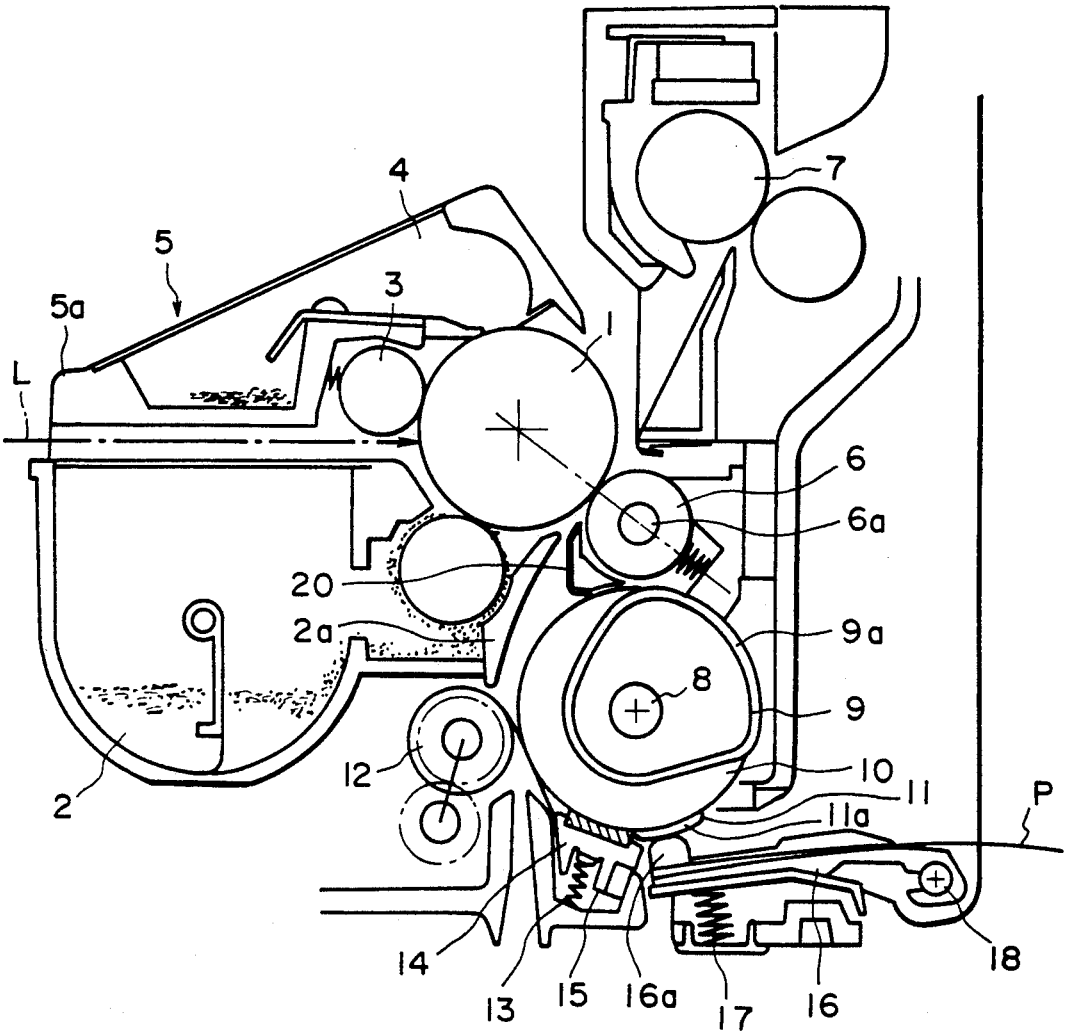
FIG. 1 is a sectional view of an image forming apparatus according to an embodiment of the present invention.

FIG. 1 shows a laser beam printer as an exemplary image forming apparatus. It comprises an image bearing member in the form of a photosensitive drum 1. Around the photosensitive drum 1, there are disposed a developing device 2, a primary charger 3, a cleaning device 4, and these process means are contained in a cartridge container 5a to constitute a process cartridge 5. The process cartridge 5 is detachably mountable to a main assembly of an image forming apparatus to make maintenance operations easier.

Adjacent the photosensitive drum 1 projected outwardly from the cartridge container 5a of the process cartridge 5, an image transfer charger in the form of a transfer charger 6 is disposed, and an image fixing device 7 is disposed at the sheet discharging side of the photosensitive drum 1. At the sheet feeding side of the transfer drum 1, a sheet feeding roller shaft 8 is rotatably mounted which extends parallel to the roller shaft 6a of the transfer charger 6 right below the roller shaft 6a, and on the sheet feeding roller shaft 8, there are coaxially fixed a sheet feeding roller 9 and swinging cams 11 and 11 for idler rollers 10 and 10. The feeding roller 9 is fixed at the center of the sheet feeding roller shaft 8. The pair of idler rollers 10 and 10 are fixed at the respective sides of the sheet feeding roller 9 and at the opposite ends of the sheet feeding roller 9, the pair of swinging cams 11 and 11 are fixed. The sheet feed roller 9 and the swinging cams 11 have substantially the same cross-sectional configuration. They are fixed eccentrically on the sheet feeding roller shaft 8. Portions 9a and 11a projecting outwardly from the idler roller 10 are disposed with different phases around the sheet feeding roller shaft 8.

A conveying roller 12 driven by an unshown driving source is urged to the idler rollers 10 and 10 right below the process cartridge 5, at a position adjacent to the photosensitive drum 1. Below the idler rollers 10 and 10, there is a spring 13 having an end supported on the main assembly and the other end urging a separation pad 15 to the idler rollers 10 and 10 by way of a pad supporter 14. To the right of the spring 13 in FIG. 1, a sheet feeding unit is disposed which comprises a recording material (transfer sheet) stacking plate 16, a spring 17 and others. The stacking plate 16 has an engaging projection 16a engageable with the swinging cams 11 at an end thereof. The other end of stacking plate 16 is rotatably supported on a shaft 18 and is resiliently urged in the clockwise direction in FIG. 1 about the shaft or pin 18 by the spring 17 disposed to the bottom side of the engaging projection 16a. Therefore, when the engagement between the projection 11a of the swinging cam 11 and the engaging projection 16a of the stacking plate 16 is released by the rotation of the sheet feeding roller shaft 8, the transfer sheet P stacked on the stacking plate 16 is urged together with the stacking plate 16 to the idler rollers 10 and 10 by the spring 17.

When the photosensitive drum 1 uniformly charged by the primary charger 3 is exposed to image light L by an unshown laser scanner, an electrostatic latent image is formed on the photosensitive drum 1. The latent image is conveyed together with the rotation of the photosensitive drum 1 to the developing device 2 where it is developed with toner into a toner image. The toner image is transferred by means of the transfer charger 6 from the photosensitive drum 1 onto the transfer sheet P at the image transfer station where the transfer charger is contacted or is contactable to the photosensitive drum 1. The photosensitive drum 1 having been subjected to the image transfer operation is cleaned by the cleaning device 4 so that the residual toner remaining thereon is removed.

On the other hand, when the engagement between the projections 11a of the swinging cams 11 and 11 and the engaging projections 16a of the stacking plate 16 is released, the transfer sheet P on the stacking plate 16 is urged to the idler rollers 10 and 10. It is fed to the separating pad 15 from the stacking plate 16 by the projection 9a of the feeding roller 9, the projection 9a reaches the sheet with delay. Then, it is conveyed to the conveying roller 12. The transfer sheet P having reached the position between the conveying roller 12 and the idler rollers 10 and 10 is conveyed to between the transfer drum 1 and the transfer charger 6 along a guiding means (transfer sheet guide plate) 20 and a guide 2a mounted on the developing device 2. The transfer charger 6 transfers the toner image from the photosensitive drum onto the transfer material. After the image transfer operation, the transfer sheet P is conveyed to the fixing device 7, and the toner image is fixed into a permanent image.

The fixing device 7, the primary charger 6, the conveying roller 12, the feeding roller shaft 8 or the like rotate about a point when the process cartridge 5 is mounted into the main assembly of the apparatus. By doing so, the photosensitive drum 1 and the primary charger 6 are spaced apart upon mounting or dismounting of the process cartridge 5 relative to the main assembly so that the friction therebetween is avoided.

A description will now be given of the supporting and positioning of the transfer charger 6, and the positioning and supporting of the transfer sheet guide plate 20.

Figure 2:
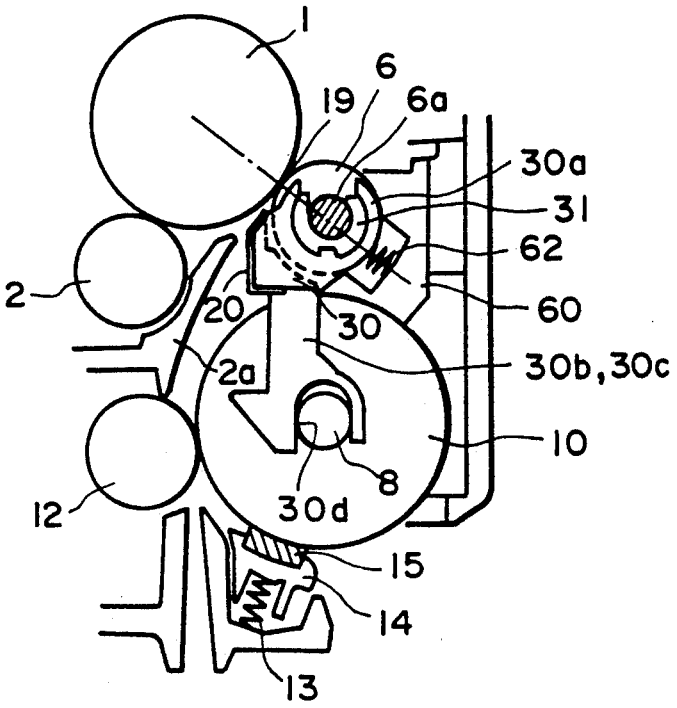
FIG. 2 is a sectional view of structure around a transfer charger of the image forming apparatus of FIG. 1.

First, with reference to FIG. 2 the transfer charger 6 includes a roller which is press-contacted to the photosensitive drum 1 to form a nip 19 therebetween through which the toner image is transferred. The roller is made of conductive material to apply a bias voltage to the photosensitive drum 1 to transfer the toner image from the photosensitive drum 1 onto the transfer sheet P. The transfer charger (transfer roller) 6 is supported by bearings 61 and 61 (FIG. 3) in a pair of transfer roller supporting brackets mounted on the main assembly.

Figure 3:
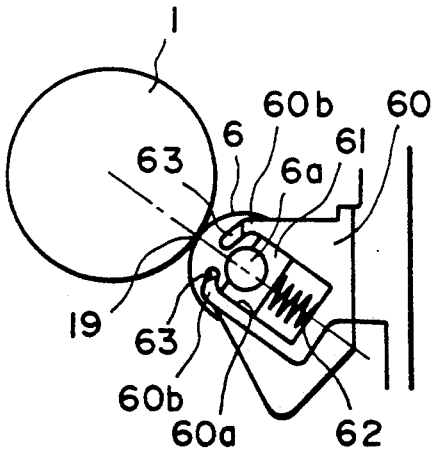
FIG. 3 illustrates supporting the transfer charger in the image forming apparatus of FIG. 2.

The shafts 6a and 6a projecting from the opposite ends of the transfer roller 6 are supported by the bearings 61 and 61 in the recesses 60a and 60a in the transfer roller brackets 60 and 60, as shown in FIG. 3 (only one end is shown), by which the transfer roller 6 is supported by the transfer roller brackets 60 and 60 mounted on the main assembly of the image forming apparatus. The recess 60a of the transfer roller bracket 60 opens toward the photosensitive drum 1, and the bearing 61 is slidably supported in the recess 60a, and a spring 62 is disposed between the bearing 61 and the bracket 60. The bearing 61 is urged to the photosensitive drum 1, and therefore, the transfer roller 6 is urged to the photosensitive drum 1 by way of the bearings 61 and 61, thus forming an image transfer nip 19 with the photosensitive drum 1. Accordingly, the transfer roller 6 is supported by the transfer roller supporting brackets 60 and 60 by way of the bearings 61 and 61, and simultaneously, it is urged to the photosensitive drum 1 so as to be correctly positioned relative to the photosensitive drum 1. At least one side of the bearings 61 and 61 is made of conductive material, so that the image transfer bias voltage can be applied to the transfer roller 6 by the bearing 61 through the spring 62.

As shown in FIG. 3, the transfer roller bracket 60 has a stopper pawls 60*b* and 63 adjacent an opening of the recess 60*a*. Then, even when the process cartridge 5 is taken out of the main assembly, and since, the photosensitive drum 1 is not in the main assembly, the stopper pawls 60*b* and 63 are effective to prevent the bearing 61 in the transfer roller bracket 60 from coming out of the bracket 60 and to prevent the roller shaft 6*a* of the transfer roller 6 from coming away from the bearing 61. However, the stopper pawl 63 is rotatable by the force beyond a predetermined level, and therefore, the transfer roller 6 can be mounted into or dismounted from the bearings 61 and 61 in the transfer roller supporting brackets 60 and 60.

A description will now be given of the supporting and positioning of the transfer sheet guide plate 20.

Figure 4:
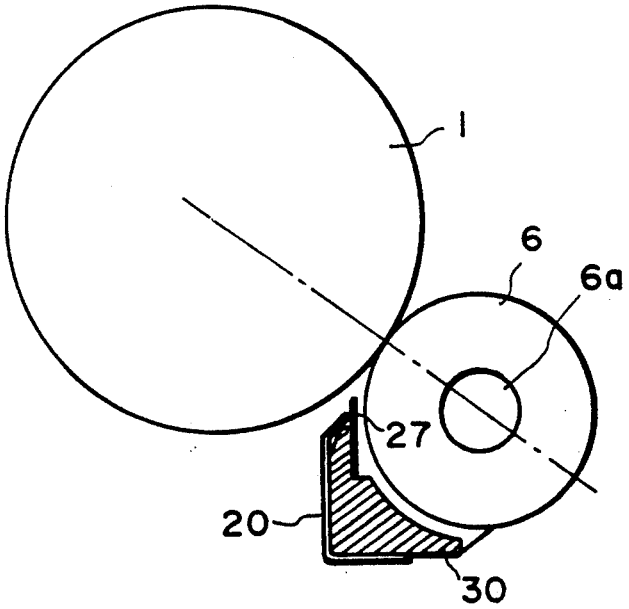
FIG. 4 is an enlarged sectional view of the image forming apparatus around a transfer sheet guide plate.

In FIGS. 1 and 4 transfer sheet guide plate 20 is mounted on a guide supporting member 30 which is supported and positioned by the transfer roller and the sheet feeding roller shaft 8 disposed below the transfer roller 6, and therefore, a fixed positional relationship is established between the transfer roller and the guide plate 20. Therefore, the transfer sheet guide plate 20 can correctly guide the transfer sheet P into the nip formed between the transfer roller 6 and the photosensitive drum 1.

Figure 5:
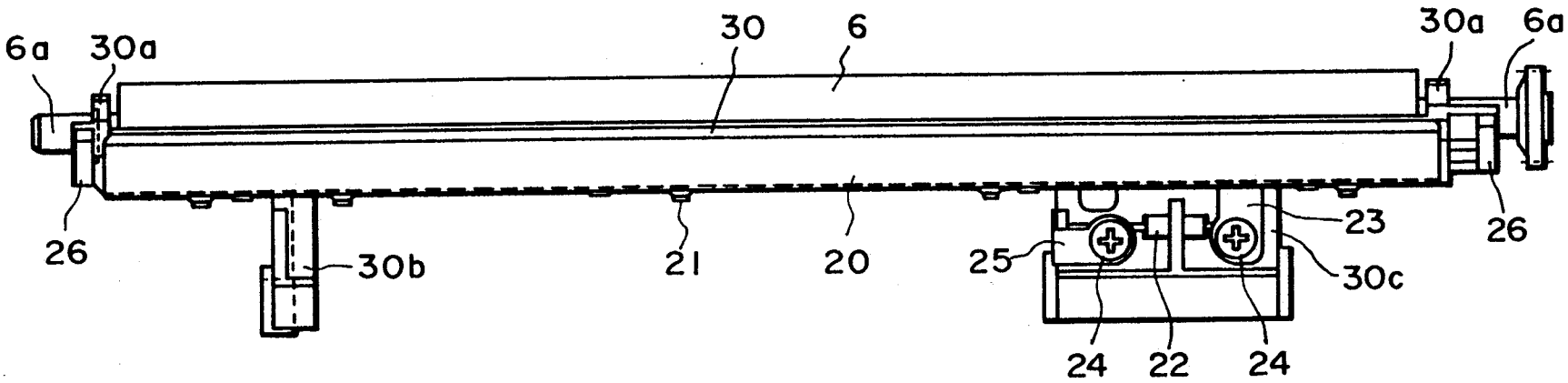
FIG. 5 is a front view of a transfer charger (transfer roller) with a transfer guide unit in the image forming apparatus.
Figure 6:
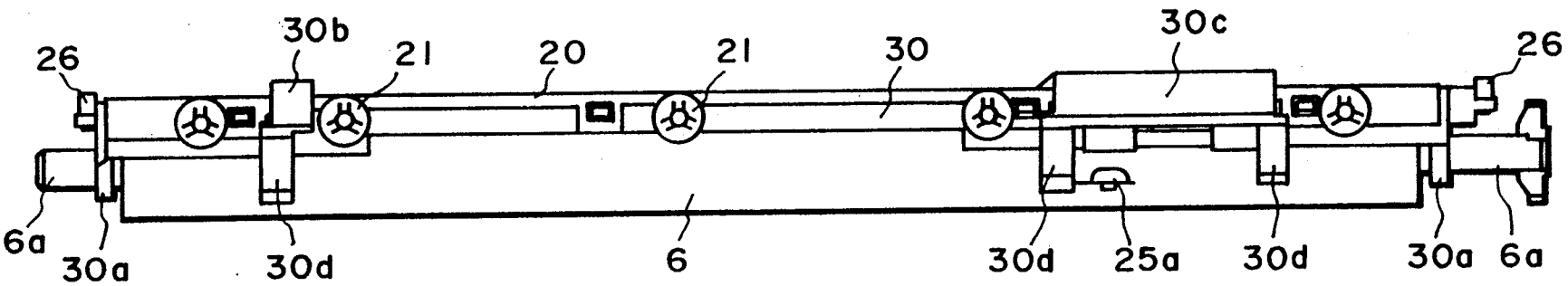
FIG. 6 is a bottom view of the transfer charger (transfer roller) with a transfer guide unit.

The guide supporting member 30 is made of insulative resin material capable of elastic deformation. As shown in FIGS. 5 and 6, it extends along the length of the transfer roller 6 to the opposite ends of the transfer roller 6, the supporting portions 30*a* and 30*a* (FIG. 5 or 6) at the opposite ends are supported by the roller shafts 6*a* and 6*a* inside the bearings 61 and 61 of the transfer roller 6, by way of the bearings 31 and 31, as shown in FIG. 2 (FIG. 2 shows only one side). It is, therefore, suspended downwardly from the roller shafts 6*a* and 6*a*. Here, the bearing 31 is mounted to the supporting portion 30*a* of the guide supporting member 30, and the supporting portion 30*a* and the bearing 31 both have upward openings. In order to mount the guide supporting member 30 to the roller shafts 6*a* and 6*a*, the supporting portions 30*a* and 30*a* are pressed into the roller shafts 6*a* and 6*a* through the bearings 31 and 31. At the right and the left end of the guide supporting member 30 in FIG. 5, there are right and left guiding portions 30*b* and 30*c* (see also FIG. 2) extending to the sheet feeding shaft 8 below the transfer roller 6. At the bottom of the left and right guiding portions 30*b* and 30*c*, U-shaped grooves 30*d* opened downwardly are formed. As shown in FIG. 2, the U-shaped groove 30*d* is engaged with the sheet feeding roller shaft 8 by which the bottom of the guide supporting member 30 is positioned, so that the guide supporting member 30 as a whole is supported and positioned by the transfer roller 6 and the sheet feeding roller 8. The sheet feeding roller 9 and the idler rollers 10 and 11 are mounted on the sheet feeding roller shaft 8 between the left and right guiding portions 30*b* and 30*c* of the guide supporting member 30.

The transfer sheet guide 20 is made of KN-plated thin metal sheet made of stainless steel or steel. As shown in FIG. 2, it has an L-cross-section and is mounted to the developing device 2 side surface of the guide supporting member 30, extending over the entire length of the guide supporting member 30, as shown in FIG. 5. It constitutes a transfer guide unit together with the guide supporting member 30. The mounting of the transfer sheet guide plate 20 to the guide supporting member 30, as shown in FIG. 6, is effected by plural screws 21 threaded from the bottom side. The L-shape of the transfer guide 20 increases its rigidity to prevent the bending or warping of the guide supporting member 30. Thus, the transfer sheet guide plate 20 is supported on the transfer roller 6 by way of the guide supporting member 30, and therefore, the transfer sheet guide plate 20 is correctly positioned relative to the transfer roller 6, so that it can be correctly positioned relative to the nip 19 formed between the transfer roller 6 and the photosensitive drum 1. Because of this, the transfer sheet P can be correctly conveyed to the nip 19 by the transfer sheet guide plate 20, and therefore, the toner image can be properly transferred from the photosensitive drum 1 to the transfer sheet P.

The transfer sheet guide 20 cooperates with the guide supporting member 30 to constitute the transfer guide unit. The guide plate 20 can be integrally assembled with the transfer roller 6 by way of the transfer guide unit, and therefore, the transfer sheet guide plate 20 can be disposed closest to the transfer roller 6. Then, by the transfer sheet guide plate 20, the transfer sheet P can be sufficiently guided up to immediately before the nip 19 formed between the transfer roller 6 and the photosensitive drum 1. Then, any possible disturbance to the image attributable to the curling or the fluctuation of the transfer sheet P can be prevented. The transfer sheet guide unit constituted by the transfer sheet guide plate 20, the guide supporting member 30 or the like is disposed close to the transfer roller 6, and therefore, a compact arrangement is possible with the advantage of the reduction of the size of the entire apparatus.

The transfer sheet guide plate 20 is supported on the transfer shafts 6*a* and 6*a* of the transfer roller 6, and can follow a slight movement of the transfer roller Therefore, it can maintain the proper distance even upon the change in the contact pressure between the transfer roller 6 and the photosensitive drum 1 and the change in the hardness of the transfer roller 6.

As shown in FIG. 5 to the right guide supporting portion 30*c* of the guide supporting member 30, a resistor 22 of several tens—several hundreds M ohm. is mounted. An end of the resistor 22 is connected by a screw 24 to a first metal plate 23 electrically connected to the transfer sheet guide plate 20. The other end is, similarly, connected by a screw 24 to an end of a second metal plate 25. As shown in FIG. 6, to the other end of the second metal plate 25, an electric contact 25*a* is formed. When the U-shaped groove 30*d* of the right supporting portion 30*c* of the guide supporting member 30 is engaged with the sheet feeding roller shaft 8, the electric contact 25*a* is press-contacted to the sheet feeding roller shaft 8, so that the sheet feeding roller shaft 8 and the electric contact 25*a* are electrically connected. Thus, the sheet feed roller shaft 8 is grounded through the conductive bearing, and therefore, the transfer sheet guide plate 20 is also electrically grounded through the resistor 22 of several tens—several hundreds M ohm. By doing so, the triboelectric charge possibly produced by the contact between the transfer sheet P and the transfer sheet guide plate 20 is released externally.

At the transfer drum 1 side (outside of the image forming region of the photosensitive drum 1) at the opposite ends of the guide supporting member 30, as shown in FIGS. 5 and 6, there are mounted spacer damper members 26 and 26 made of ultra-high polyethylene, teflon or POM which does not damage the photosensitive drum 1 upon contact therewith. When the transfer sheet guide plate 20 is going to contact the photosensitive drum 1 during a vibration or impact during the operation or upon jam clearance operation, the spacer damper members 26 and 26 are first brought into contact with the photosensitive drum 1, so as to prevent damage to the photosensitive drum 1 by the transfer sheet guide plate 20.

Adjacent the portion of the transfer sheet guide plate 20 which is closest to the photosensitive drum 1 and the transfer roller 6, as shown in FIG. 4, a thin insulative sheet 27 made of Myler (polyethylene terephthalate: PET) or PC is disposed between the guide plate 20 and the transfer roller 6, or between the guide plate 20 and the photosensitive drum 1, by which the leakage of the bias voltage to the transfer roller to the transfer sheet guide plate 20 is prevented.

Thus, the transfer sheet guide plate 20 is grounded by way of the resistor 22 or the like, and therefore, the bias voltage applied from the transfer roller 6 to the photosensitive drum 1 is relatively easily leaked externally by the transfer sheet guide plate 20. However, between the transfer sheet guide plate 20 and the charging roller 6, the guide supporting member 30 and the insulative sheet 27 made of insulative resin are disposed, and therefore, the bias voltage of the transfer roller 6 does not leak through the transfer sheet guide plate 20. Therefore, transfer sheet guide plate 20 can be disposed close to the transfer roller 6 by the guide supporting member 30 or the like, whereby the size of the entire apparatus can be reduced.

In addition, the provision of the insulative sheet 27 or the like permits disposition of the end of the transfer sheet guide plate 20 close to the nip 19 formed between the transfer roller 6 and the photosensitive drum 1 (1 mm, for example), and therefore, even if the transfer sheet P is curled or waved, the transfer sheet P can properly receive the image from the photosensitive drum 1.

Figure 7:
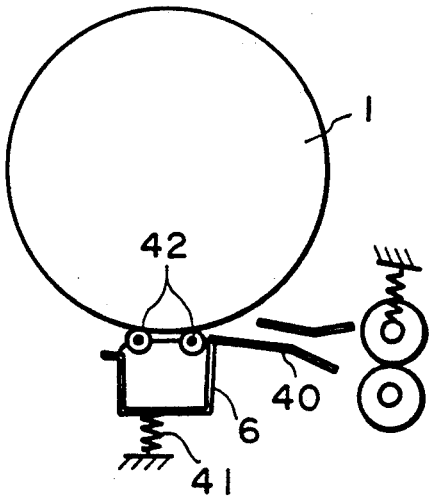
FIG. 7 is a sectional view of structure around a transfer charger of an image forming apparatus according to another embodiment of the present invention.

Referring to FIG. 7, a second embodiment will be described. In this embodiment, the transfer charger 6 is in the form of a corona charger. The corona charger 6 is urged toward the photosensitive drum 1 by a spring 41. By the contacts of rollers 42 and 42 to the photosensitive drum 1, the corona charger 6 is correctly positioned relative to the photosensitive drum 1. To an end of the corona charger 6, a transfer sheet guide plate 40 is mounted, and the transfer sheet guide plate 40 is positioned relative to the photosensitive drum 1 with sufficient precision. Therefore, the transfer sheet guide plate 40 permits proper conveyance of the transfer sheet P to the transfer position formed between the photosensitive drum 1 and the corona charger 6.

Figure 8:
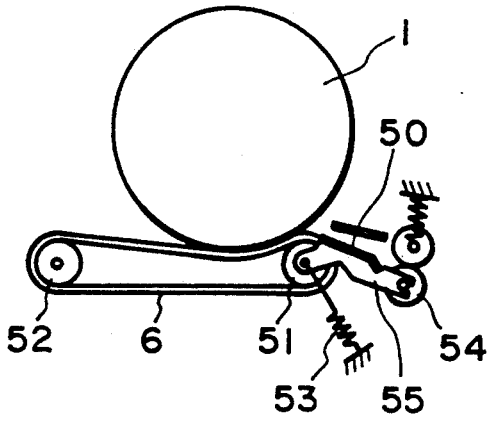
FIG. 8 is a sectional view of structure around a transfer charger of an image forming apparatus according to a third embodiment of the present invention.
Figure 9:
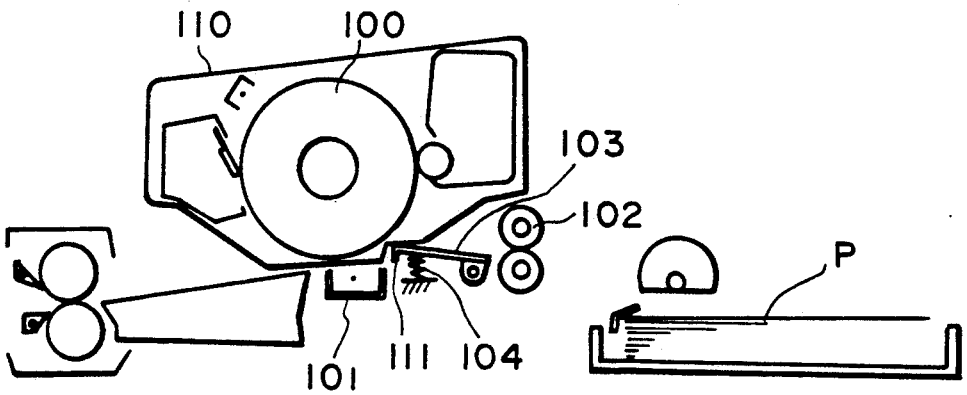
FIGS. 9, 10 and 12 illustrate conventional image forming apparatus.
Figure 10:
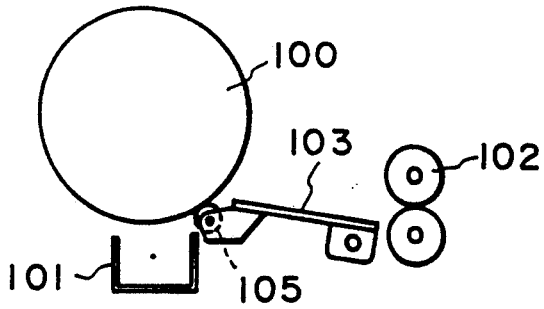

Referring to FIG. 8, there is shown a third embodiment wherein the transfer charger 6 is in the form of a transfer belt. The transfer belt 6 is stretched around two rollers 51 and 52 along an endless path. One of the rollers 51 is urged toward the photosensitive drum 1 by a spring 53, by which the transfer belt 6 is urged to the photosensitive drum 1 to effect the image transfer operation.

In this case, too, an end of the transfer sheet guide plate 50 is rotatably mounted on a shaft of the roller 51 of the transfer belt 6 by way of a guide supporting member 55, and the other end is guided and supported on the roller shaft of the registration roller 54 by way of the guide supporting member 55, by which the transfer sheet guide plate is correctly positioned, and therefore, the same advantageous effects as in the first embodiment can be provided.

Figure 11:
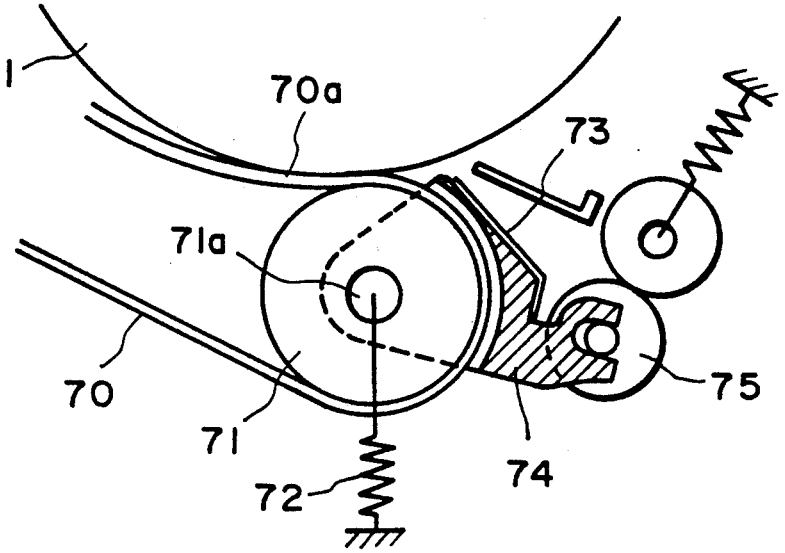
FIG. 11 illustrates a further embodiment of the present invention.
Figure 12:
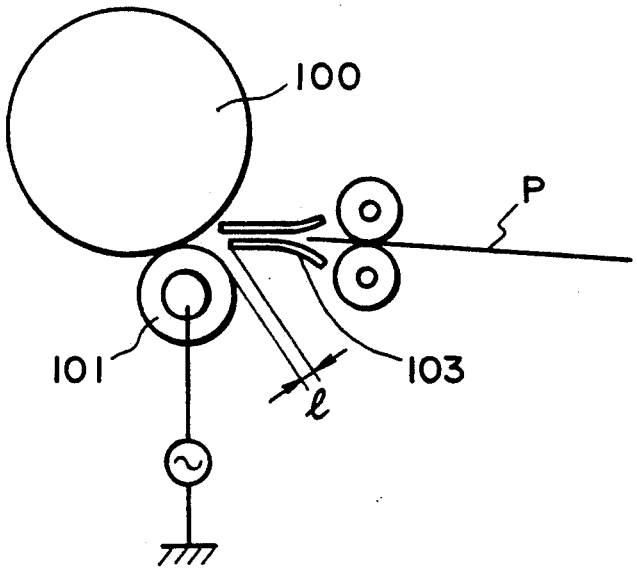

Referring to FIG. 11, a further embodiment will be described wherein the transfer charger is in the form of a transfer belt 70 which is stretched around an unshown roller and a roller 71 along an endless path. A roller shaft **71*a* of the roller 71 is urged to the photosensitive drum 1 by a spring 72, by which the transfer belt 70 is urged to the photosensitive drum 1** to effect the image transfer operation.

In this case, too, a guide supporting member 74 made of insulative resin material is disposed between the transfer sheet guide plate 73 and the transfer belt 70 so as to prevent the bias voltage to from leaking between the transfer belt 70 and the transfer sheet guide plate 73. Therefore, the transfer sheet guide plate 73 can be sufficiently closely disposed to the contact portion between the photosensitive drum 1 and the transfer belt 70. In addition, the transfer sheet guide plate 73 may be sufficiently closely disposed to the transfer belt 70. Therefore, the same advantageous effects can be provided, and in addition, the transfer sheet can properly receive the image even if the transfer sheet P is curled or waved.

One of the guide supporting members 73 is rotatably supported on the roller shaft **71*a*, and the other is guided and supported on the registration roller 75, and therefore, the transfer sheet guide plate 73 supported on the guide supporting member 74 can be correctly positioned relative to the contact portion 70 between the photosensitive drum 1 and the transfer belt 70. By the transfer sheet guide plate 73, the transfer sheet P can be correctly conveyed to the contact portion 70*a***. Therefore, the proper image transfer to the transfer sheet P is possible.

As will be understood from the foregoing, according to the present invention, the transfer means is contacted to the image bearing member to correctly position it relative to the image bearing member, and in addition, the transfer material guide is supported on the transfer means to correctly position it, so that the transfer material guide can be correctly positioned relative to the transfer station between the image bearing member and the transfer means, and therefore, improper image production does not occur upon the image transfer.

In addition, by the provision of the insulative resin material, the transfer material guide can be more closely disposed relative to the transfer roller, and therefore, the transfer material can be more correctly guided to the contact portion between the transfer roller and the image bearing member, and therefore, the occurrence of an improper image transfer can be prevented together with the advantage of producing a small size apparatus.

In addition, the transfer guide is not contacted to the image bearing member for the positioning, and therefore, damage to the photosensitive member is prevented.

While the invention has been described with reference to the structures disclosed herein, it is not confined to the details set forth and this application and is intended to cover such modifications or changes as may come within the purposes of the improvements or the scope of the following claims.

What is claimed is:

1. An image forming apparatus, comprising:

an image bearing member;

means for forming an image on said image bearing member;

transfer means for transferring the image from said image bearing member onto a recording material, said transfer means comprising a rotatable transfer member supplied with a voltage and having a shaft, said rotatable transfer member being contactable to said image bearing member, and said rotatable transfer member being movable toward and away from said image bearing member; and a guiding member for guiding the recording material to a neighborhood of said image bearing member;

wherein said guiding member is supported by the shaft of said rotatable transfer member so that a relative positional relationship between said rotatable transfer member and said guiding member does not change even if said rotatable transfer member moves toward or away from said image bearing member.

2. An apparatus according to claim 1, wherein said image bearing member includes a photosensitive member.

3. An apparatus according to claim 1, wherein said notatable transfer member is electrically conductive.

4. An apparatus according to claim 1, wherein said notatable transfer member is pressed to said image bearing member.

5. An apparatus according to claim 1, wherein a relative positional relationship between the shaft of the rotatable member and said guiding member does not change even when said rotatable transfer member moves toward and away from said image bearing member.

6. An apparatus according to claim 5, further comprising a feeding roller for feeding the recording material to said apparatus, said feeding roller having a shaft.

7. An apparatus according to claim 6, wherein said guiding member is supported by a frame that is supported by the shaft of said rotatable transfer member and the shaft of said feeding roller.

8. An apparatus according to claim 5, wherein said guiding member is fixed on the shaft of said rotatable transfer means member by way of an insulating member.

9. An apparatus according to claim 8, wherein the insulative member is elastically deformable.

10. An apparatus according to claim 1, wherein said guiding member includes a thin metal sheet.

11. An apparatus according to claim 1, wherein said guiding member is at an upstream side of said rotatable transfer member with respect to a movement direction of the recording material.

12. An apparatus according to claim 1, wherein said image bearing member and said image forming means are contained in a process cartridge as a unit and said process cartridge is detachably mountable to said apparatus.

13. An apparatus according to claim 12, wherein said process cartridge includes charging means for uniformly charging said image bearing member, an opening for exposing said image bearing member to image information to form a latent image thereon, developing means for developing the latent image into a toner image, and means for removing toner remaining on said image bearing member.

14. An image forming apparatus, comprising:

an image bearing member;

means for forming an image on said image bearing member;

transfer means for transferring the image electrostatically onto a recording material, said transfer means being contactable to said image bearing member;

a guiding member for guiding the recording material to a neighborhood of said image bearing member, said guiding member extending to a neighborhood of a contact portion between said image bearing member and said transfer means, wherein said guiding member is electrically conductive and is electrically connected to a ground; and an insulating member disposed between said transfer means and an end of said guiding member adjacent the contact portion.

15. An apparatus according to claim 14, wherein said image bearing member includes a photosensitive member.

16. An apparatus according to claim 14, wherein said transfer means is electrically conductive.

17. An apparatus according to claim 14, wherein said transfer means is pressed to said image bearing member.

18. An apparatus according to claim 14, wherein said guiding member is fixed to a shaft of said transfer means.

19. An apparatus according to claim 18, further comprising a feeding roller for feeding the recording material to said apparatus.

20. An apparatus according to claim 19, wherein said transfer means comprises a roller, and wherein said guiding member is fixed to a shaft of said transfer means by way of a frame provided between a roller shaft of said transfer means and a roller shaft of said feeding roller.

21. An apparatus according to claim 18, wherein said guiding member is fixed on a shaft of said transfer means by way of a second insulating member.

22. An apparatus according to claim 21, wherein the second insulative member is elastically deformable.

23. An apparatus according to claim 14, wherein said guiding member includes a thin metal sheet.

24. An apparatus according to claim 14, wherein said guiding member is at an upstream side of said transfer means with respect to a movement direction of the recording material.

25. An apparatus according to claim 14, wherein said image bearing member and said image forming means are contained in a process cartridge as a unit and said process cartridge is detachably mounted to said apparatus.

26. An apparatus according to claim 25, wherein said process cartridge includes charging means for uniformly charging said image bearing member, an opening for exposing said image bearing member to image information to form a latent image thereon, developing means for developing the latent image into a toner image, and means for removing toner remaining on said image bearing member.

27. An apparatus according to claim 21, wherein said insulative member is disposed between said second insulative member and said transfer means.

28. An apparatus according to claim 14, wherein said insulative member is made of polyethylene terephthalate or polycarbonate.

29. An apparatus according to claim 1, further comprising:

supporting means for supporting said shaft, and for supporting said guiding member, and wherein a relative positional relationship among said shaft, said supporting means, and said guiding member does not change even if the rotatable member moves toward or away from said image bearing member.

30. An apparatus according to claim 1, wherein said rotatable transfer member comprises a roller and a belt disposed around said roller.

31. An apparatus according to claim 1, wherein said guiding member is electrically conductive and is connected to ground and extends to a neighborhood of a contact portion between said image bearing member and the rotatable member, said apparatus further comprising an insulating member disposed between an end of said guiding member adjacent the contact portion and the rotatable member.

32. An apparatus according to claim 1, further comprising supporting means for supporting said rotatable transfer member and said guiding member, and wherein a relative positional relationship among said rotatable transfer member, said supporting means, and said guiding member does not change even if said rotatable transfer member moves toward or away from said image bearing member.

33. An apparatus according to any one of claims 1, 5, 7, 8, 29, or 32, wherein said guiding member comprises a plate.

34. An apparatus according to any one of claims 14, 27, or 28, wherein said insulative member comprises a sheet.

35. An apparatus according to claim 14, wherein said transfer means comprises a rotatable member.

36. An apparatus according to claim 14, wherein said guide member comprises a plate.

37. An apparatus according to claim 14, wherein a resistance is connected between said guiding member and the ground.

38. An apparatus according to claim 14, wherein said guiding member is of metal.

* * * * *

UNITED STATES PATENT AND TRADEMARK OFFICE

CERTIFICATE OF CORRECTION

PATENT NO. : 5,276,489

DATED : January 4, 1994

INVENTOR(S) : YUTAKA KIKUCHI, ET AL.

It is certified that error appears in the above-identified patent and that said Letters Patent is hereby corrected as shown below:

COLUMN 1
Line 17, "is" should read --are--; and
Line 59, "clearance" should read --clearance.--.

COLUMN 4
Line 42, "FIG. 2" should read --FIG. 2,--; and
Line 60, "and" should be deleted.

COLUMN 5
Line 11, "since," should read --since--; and
Line 24, "1 and 4" should read --1 and 4,--.

COLUMN 8
Line 68, "and" (second occurrence) should be deleted.

COLUMN 9
Line 30, "notatable" should read --rotatable--;
Line 32, "notatable" should read --rotatable--; and
Line 49, "means" should be deleted.

Signed and Sealed this

Twenty-first Day of June, 1994

*Attest:*

Bruce Lehman

BRUCE LEHMAN

*Attesting Officer*

*Commissioner of Patents and Trademarks*